United States Patent [19]

Kockott et al.

[11] 4,181,926

[45] Jan. 1, 1980

[54] ILLUMINATING FIXTURE FOR SURGICAL LIGHT

[75] Inventors: Dieter Kockott, Hanau am Main; Joachim Bensel, Steinau, Fed. Rep. of Germany

[73] Assignee: Original Hanau Quartzlampen GmbH, Hanau am Main, Fed. Rep. of Germany

[21] Appl. No.: 910,352

[22] Filed: May 30, 1978

[30] Foreign Application Priority Data

Jun. 4, 1977 [DE] Fed. Rep. of Germany ..... 2725428

[51] Int. Cl.[2] ..... A61G 13/00

[52] U.S. Cl. ..... 362/33; 362/294; 362/345; 362/373

[58] Field of Search ..... 362/33, 294, 345, 373

[56] References Cited

U.S. PATENT DOCUMENTS 2,356,592 8/1944 Kolbert et al. ..... 362/33

*Primary Examiner*—Stephen J. Lechert, Jr.

*Attorney, Agent, or Firm*—Frishauf, Holtz, Goodman & Woodward

[57] ABSTRACT

Enclosure for an illuminating fixture used in operating rooms. The enclosure comprises an upper enclosure section and a lower enclosure section which are heat insulated from each other. The lower section contains an opening for the transmission of light from the light source enclosed in the fixture. The inner surface of the lower section has good reflection characteristics for infrared light. The inner surface of the upper section has good characteristics for absorbing infrared light. The outside (back) surface of the upper section has good characteristics for emitting heat.

9 Claims, 4 Drawing Figures

ILLUMINATING FIXTURE FOR SURGICAL LIGHT

BACKGROUND OF THE INVENTION

Enclosures for illuminating fixtures used in operations comprising an upper section and a lower section containing an aperture for passage of the light from the light source, with said sections heat insulated from each other, are known. DT-OS 2305664 discloses means for preventing overheating of illuminating fixtures used in operating rooms. The enclosure is in the form of a bell-shaped envelope which absorbs the infrared radiation. The envelope (housing) contains one or more vents, at least in the upper portion of a bell-shaped inverted dome. The bell-shaped envelope is provided with a black matt finish. Although such a device did result in reducing the discomfort to the surgical staff resulting from heat, the reduction in the amount of heat was not sufficient to provide satisfactory conditions.

It is an object of the invention to provide an illuminating fixture for an operating room utilizing an enclosure which by relatively simple means is characterized by predominately directing heat radiation toward that portion of the enclosure which is in the direction away from the surgery, at the same time minimizing the amount of heat radiation directed toward the surgery and surgical staff.

THE INVENTION

The invention provides an illuminating fixture housing enclosure comprising an upper section and a lower section. The inner surface of the lower section has a highly reflective finish, at least for radiation wavelengths greater than the wavelengths of the visible light spectrum. Such radiation having wavelengths greater than the visible light spectrum is often referred to as "infrared" or "heat radiation." The inner surface of the upper section of the enclosure is provided with a surface having good characteristics for absorbing infrared light radiation. The outer surface of this outer section is provided with a surface having good heat emissive characteristics. The upper section of the fixture consists of a material having good conductivity, preferably a metal, and particularly aluminum. The lower section may also be constructed of material having similar or the same characteristics.

BRIEF DESCRIPTION OF THE DRAWINGS

The invention is illustrated in the drawings wherein.

Figure 1:
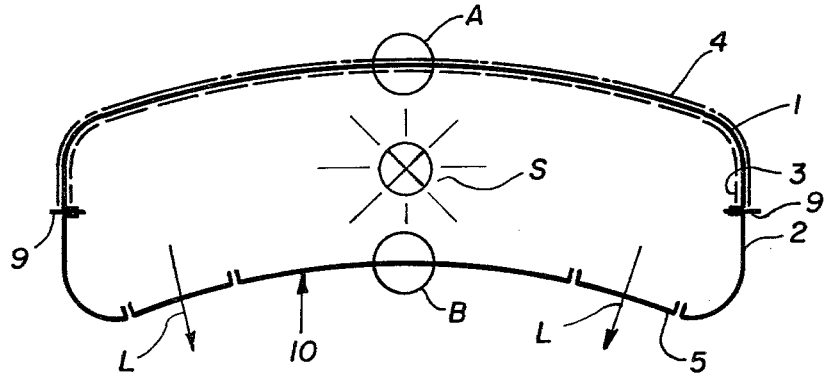
FIG. 1 is a vertical cross section through an illuminating fixture of the present invention.

The enclosure retains a light source S, shown only schematically. The lower surface is transparent at portions 5 to pass light as schematically shown by arrows L, and opaque at portion 10.

The inner surface of the portion 10 of the lower section 2 of the enclosure is a good reflector of radiation, and particularly infrared radiation. This good reflector surface is preferably a polished metal surface. When the lower section of the enclosure is metal, for example, aluminum, it is finished with a smooth polished surface. If it is not metal, it is preferably finished with a reflecting metallic coating, e.g., a vapor-deposited aluminum on a nonmetal substrate.

The inner surface of the upper section 1 of the enclosure which absorbs infrared radiation may be given a black oxide coating or another black heat-absorbing coating of the type used in solar collectors, e.g, a black varnish coating. The outer surface of the upper section of the enclosure should have a pleasing asthetic appearance and, of course, must have good heat emissive characteristics for heat radiation at the prevailing temperature of the upper enclosure during operation of the lamp. Commercially available varnishes which have high heat emissivity characteristics when applied as the surface of heat radiator opening at about 60° C. have been tested and proven useful. Such lacquer coated radiators exhibit a coefficient of emission of $\sigma=0.90$.

The housing of the present invention is further illustrated in the drawings depicting the housing having the upper enclosure section 1 and the lower enclosure section 2 which contains one or more openings 5 for transmitting the radiant light to the surgery. For purposes of better depicting the present invention, the drawing illustrate the light source with its associated reflector (s) which would be housed in the enclosure to provide the light only schematically.

Figure 2:
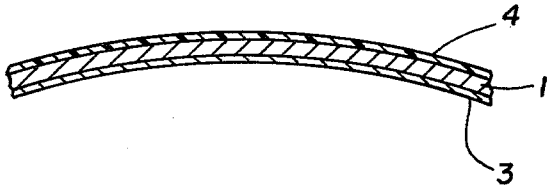
FIG. 2 is an enlarged view of the detail A through the cross section of the upper section of the enclosure.

In the preferred embodiment, the upper enclosure section 1 is made of a metal, preferably aluminum. The inner surface 3, as illustrated in an enlarged scale in FIG. 2 is a black oxidized surface, or coated with a black lacquer, to provide good heat absorption characteristics. The opposite surface of the upper enclosure (i.e., the outer surface) has a surface coating 4 of a coating, preferably a lacquer, which has good heat emission characteristics for heat radiators operating at temperatures of about 60° C.

Figure 3A:
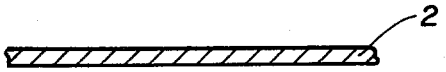
FIG. 3*a* is an enlarged view of the detail B from the lower section of the enclosure of one embodiment of the invention.
Figure 3B:
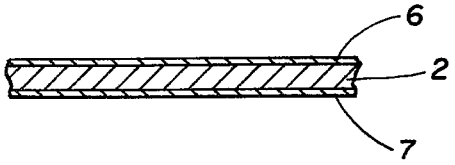
FIG. 3*b* is an enlarged view through the detail B of another embodiment of the invention.

FIGS. 3*a* and 3*b* illustrate two embodiments of the lower enclosure section 2. FIG. 3*a* illustrates a metal enclosure, preferably aluminum, 2 having a smooth and preferably polished surface.

FIG. 3*b* illustrates another embodiment wherein the lower section of the enclosure comprises a substrate material 2 containing an inner infrared reflecting coating 6. The outer surface is coated with a corrosion-protective coating 7.

The advantages of the enclosure of the present invention is strikingly illustrated by a comparison of the temperature of the upper and lower enclosure sections. Whereas with known fixtures for operating room use, the upper and lower enclosure sections may be at substantially the same temperature, and sometimes the lower section of the enclosure may be at a higher temperature than the upper enclosure section. The enclosure of the present invention is different, with the upper enclosure section preferably being at a temperature of about 15° C. to 25° C. higher than the temperature of the lower enclosure section. In all cases, the upper enclosure section is at a higher temperature than the lower enclosure temperature.

Operating room lights necessarily produce considerable heat radiation. The enclosure of the illuminating fixture of the present invention directs substantial amounts of said heat in the direction away from the operating table and the surgical team. This permits the surgical team to operate without substantial heat discomfort. It also prevents unnecessary exposure of the body openings to excess heat during surgery.

The upper enclosure section 1 and the lower enclosure section 2 may be connected to each other in a heat insulating manner by placing a ring 9 of heat insulating material, such as a rubber ring between enclosure section 1 and enclosure section 2. The enclosure sections 1 and 2 are thus connected to form an essentially closed structure.

A useful material for forming the heat emissive coating 4 is a lacquer sold by the firm BASF Lack Chemie, Cologne (West Germany) under the mark GK 1-21 050. The thickness of the heat emissive coating is at least 2 microns.

A useful material for forming the heat absorbing varnish 3 is a lacquer sold by the firm BASF Lack Chemie, Cologne (West Germany) under the mark GF 33-9499. The thickness of the heat absorbing varnish is at least 2 microns.

Various changes and modifications may be made within the scope of the inventive concept.

What is claimed is:

1. Illuminating fixture enclosure adapted to contain a radiation source (S) emitting visible light and infrared radiation, particularly suitable for operating room purposes comprising an upper enclosure section (1) and a lower enclosure section (2), heat insulated from each other, said lower enclosure section (2) including means (5) for passing visible light from the inside of the enclosure to the outside thereof, said lower enclosure section having an inner infrared radiation reflecting surface for reflecting infrared radiation toward said upper enclosure section, said upper enclosure section (1) having an inner infrared radiation absorbing surface (3) and an outer heat emitting surface (4) in heat conducting relationship with said inner infrared radiation absorbing surface, whereby infrared radiation from the interior of the enclosure is absorbed by said upper enclosure section (1) and emitted at the outer heat-emitting surface thereof to reduce the amount of infrared radiation radiated from the lower enclosure section (2).

2. The enclosure of claim 1 wherein said lower enclosure section is composed of metal.

3. The enclosure of claim 2 wherein said metal is aluminum.

4. The enclosure of claim 2 wherein said lower enclosure has a polished metal reflecting surface for reflecting infrared radiation.

5. The enclosure of claim 1 wherein said lower enclosure section has an inner reflective metallized surface for reflecting infrared radiation.

6. The enclosure of claim 1 and 2 wherein said upper enclosure section is composed of metal.

7. The enclosure of claim 4 or 5 wherein said upper enclosure section is composed of aluminum.

8. The enclosure of claim 7 wherein said inner infrared radiation absorbing surface is a black varnish surface coating.

9. The enclosure of claim 7 wherein said inner infrared radiation absorbing surface is a black oxide surface coating.

* * * * *